US006711756B1

(12) United States Patent
Mollendor

(10) Patent No.: US 6,711,756 B1
(45) Date of Patent: Mar. 30, 2004

(54) SANITARY TOILET SEAT COVER

(76) Inventor: Sheila Mollendor, 9625 W. 91st Ave., Broomfield, CO (US) 80021

( * ) Notice: Subject to any disclaimer, the term of this patent is extended or adjusted under 35 U.S.C. 154(b) by 0 days.

(21) Appl. No.: 10/142,571

(22) Filed: May 9, 2002

(51) Int. Cl.[7] ..... A47K 13/14
(52) U.S. Cl. ..... 4/245.4; 4/245.1; 4/245.3; 4/245.7
(58) Field of Search ..... 4/245.3–245.8, 4/239; D23/309, 311

(56) References Cited

U.S. PATENT DOCUMENTS 3,348,243 A 10/1967 Kelly
3,579,669 A 5/1971 Lowenstein
4,359,787 A 11/1982 Shoji
4,766,617 A 8/1988 Thygesen et al.
4,781,306 A 11/1988 Smith
4,979,237 A * 12/1990 Hazar et al. ..... 4/244.1
5,216,760 A * 6/1993 Brown et al. ..... 4/300.3
5,551,096 A 9/1996 Gardner
5,953,764 A 9/1999 Lin
6,058,518 A 5/2000 Akazawa
6,073,274 A 6/2000 McQueen

* cited by examiner

*Primary Examiner*—Henry Bennett
*Assistant Examiner*—Amanda Flynn
(74) *Attorney, Agent, or Firm*—Ramon L. Pizarro; Ronin H. Crabtree

(57) ABSTRACT

A toilet seat cover that includes a sheet of impermeable material and at least one section of adhesive material. The section of adhesive material having an upper surface and a lower surface, the lower surface of the section of adhesive material being attached to the sheet of impermeable material using an adhesive of a high peel strength that prevents the section of adhesive material from being easily removed from the sheet of impermeable material. The upper surface of the section of adhesive material having an adhesive of a low peel strength, so that the sheet may be folded upon itself to cover the upper surface of section of adhesive material, so that unfolding of the sheet of impermeable material exposes the upper surface of the section of adhesive material, so that the upper surface of the section of adhesive material may then be placed on the surface of a toilet seat to retain the toilet seat cover over the toilet seat.

7 Claims, 4 Drawing Sheets

SANITARY TOILET SEAT COVER

BACKGROUND OF THE INVENTION (a) Field of the Invention

This invention generally relates to a sanitary cover for use over a toilet seat. And more particularly, but not by way of limitation, to a flexible disposable cover that includes an impermeable layer of material with areas of releasable adhesive.

(b) Discussion of Known Art

The need for a device a sanitary cover for a toilet seat has long been recognized. Examples of these covers typically involve stacked layers of cover material, such as the example found in U.S. Pat. No. 3,348,243 to Kelly, U.S. Pat. No. 6,041,450 to Akazawa, or U.S. Pat. No. 3,579,669 to Lowenstein. These stacked covers are designed as part of a toilet facility, and are not fairly transportable by an individual who wishes to use the seat covers at an unfamiliar toilet facility. Thus, these devices do not address the need for a portable device or system that can be carried a person's coat pocket or purse, and allow the person to securely cover an unfamiliar toilet seat.

FIGS. 8, 20 and 21 of U.S. Pat. No. 4,979,237 to Hazar et al., and U.S. Pat. No. 4,766,617 include other examples of devices that can be easily transported, and concealed or stowed while being transported. These devices, however, offer few advantages over simply transporting sheets of toilet paper, or individual sheets of the well-known toilet seat covers that are found in many airport restrooms or other public restrooms.

An important problem that must be addressed by a toilet cover is the need for providing an impermeable layer that prevents fluids that may be found on a toilet seat from soaking through the cover. Additionally, the toilet seat cover should be easily secured to the toilet seat. Many known devices, such as the Hazar et al. include known examples of how to secure the cover to the surface of a toilet seat. The approach with these devices typically involves the use of an adhesive with a peel away cover. The use of a peel-away cover over the adhesive introduces serious limitations to the product in that a toilet seat cover may need to be deployed on very short notice, and thus the user may not have the time to peel the individual adhesive covers before placing the toilet seat cover over the toilet seat.

Thus, there remains a need for a sanitary toilet seat cover that can be easily deployed.

Still further, there remains a need for a toilet seat cover that is impermeable.

There remains a need for an impermeable toilet seat cover that can be easily contained in a portable pouch and then quickly deployed and secured against a toilet seat in the field.

SUMMARY

It has been discovered that the problems left unanswered by known art can be solved by providing a toilet seat cover that includes:

A sheet of impermeable material; and

At least one section of adhesive material, the section of adhesive material having an upper surface and a lower surface, the lower surface of the section of adhesive material being attached to the sheet of impermeable material using an adhesive of a high peel strength that prevents the section of adhesive material from being easily removed from the sheet of impermeable material, the upper surface of the section of adhesive material having an adhesive of a low peel strength, so that the sheet may be folded upon itself to cover the upper surface of section of adhesive material, so that unfolding of the sheet of impermeable material exposes the upper surface of the section of adhesive material, so that the upper surface of the section of adhesive material may then be placed on the surface of a toilet seat to retain the toilet seat cover over the toilet seat.

According to an example of the invention, it is contemplated that the sheet of impermeable material will include an upper surface and a lower surface. The upper surface of the sheet of impermeable material having a layer of cushioning material attached thereto. Examples of the sheet of cushioning material include materials such as paper tissue material, fibrous materials such as soft fabrics or matting, or soft foam materials.

It is further contemplated that the adhesive low peel strength material may be of the type used in POST-IT® notes, such as the adhesive described in U.S. Pat. No. 3,857,731 to Merrill, Jr. et al., incorporated herein in its entirety by reference, and U.S. Pat. No 3,691,140 to Silver, also incorporated in its entirety by reference.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Turning now to FIGS. 1–3C where an example of a disposable, sanitary, protective cover 10 for a toilet seat 12 has been illustrated. The illustrated example has been shown as being made from a sheet of impermeable material 13 having an upper surface 14 that is generally oval in shape. However, it is contemplated that the cover 10 may be generally square, rectangular or of any other shape that provides sufficient surface area to cover the surface area of the toilet seat 12.

Figure 1:
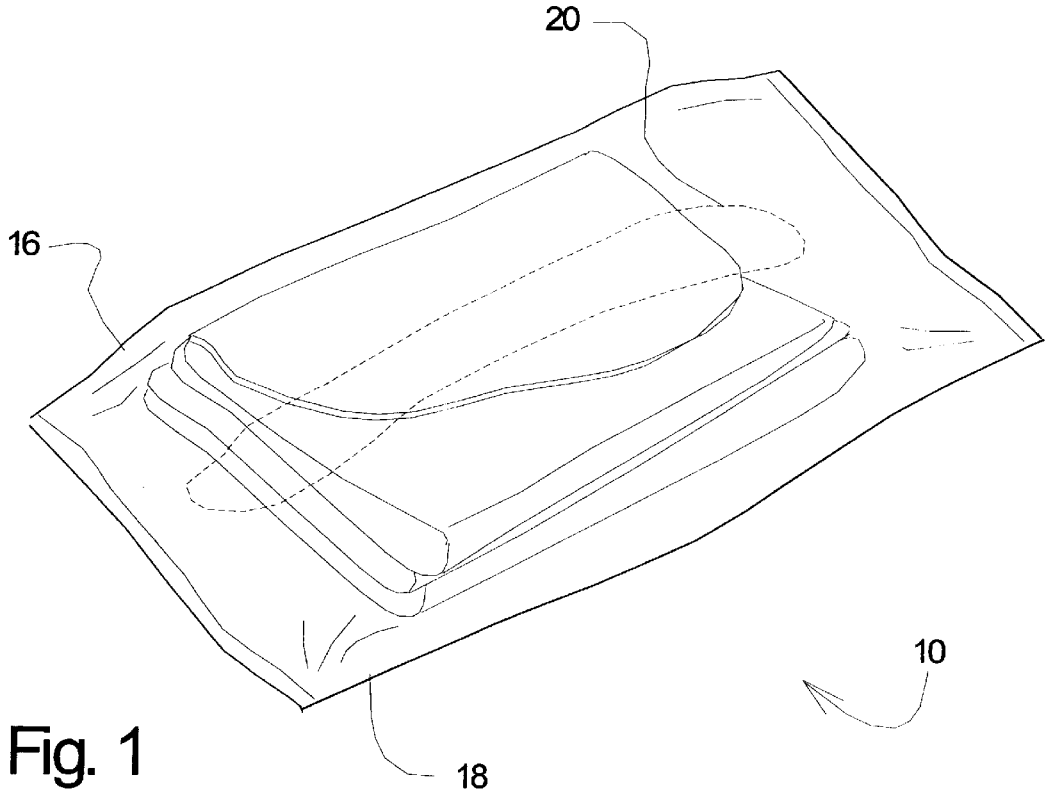
FIG. 1 is a perspective view of an embodiment of the invention in a sales package. The package having a tear-open panel.
Figure 2:
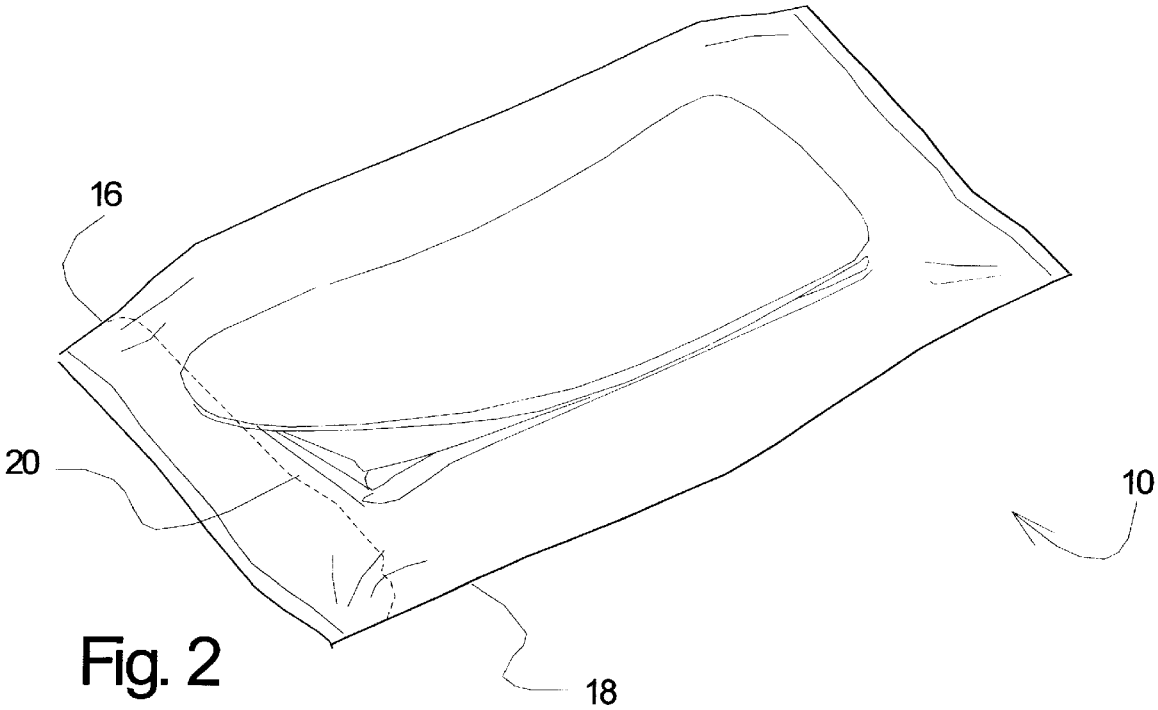
FIG. 2 is a perspective view of another embodiment of the invention in a sales package. The package having a tear-open end.
Figure 3A:
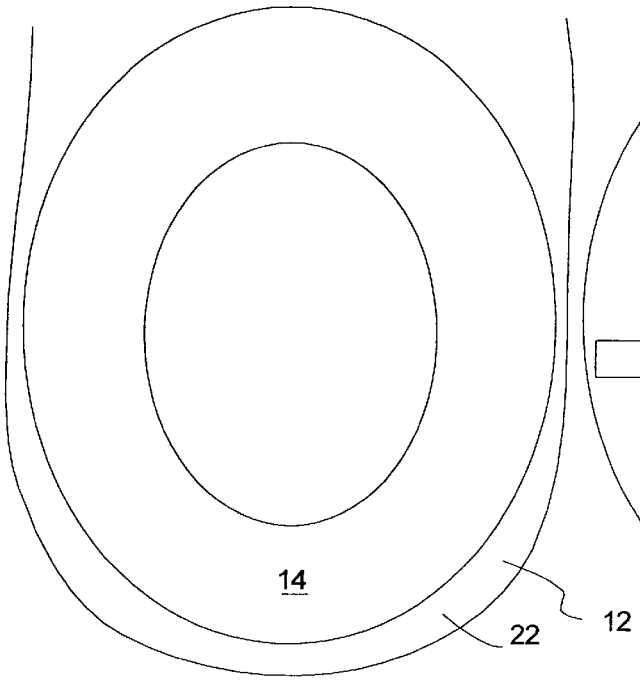
FIG. 3A is a plan view of the top surface of an embodiment of the cover.
Figure 3B:
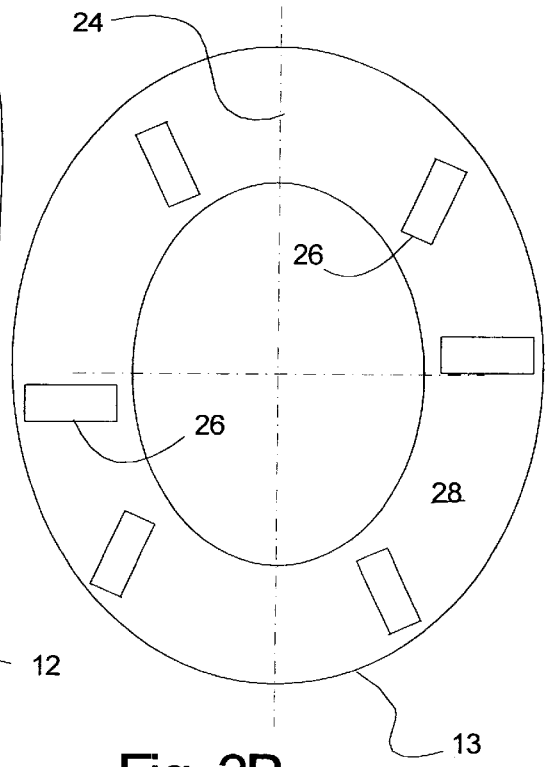
FIG. 3B is a plan view of the bottom surface of the embodiment illustrated in FIG. 3A.

As shown on FIGS. 1 and 2, it will be understood that it is contemplated that the cover 10 sold in an enclosure 16, which as illustrated may be a flexible bag 18 or pouch with a perforated area 20 that allows the bag 18 to be opened and the folded cover that is stored therein pulled out. Once the folded cover 10 is removed from the bag 18, the user will then proceed to unfold the cover 10 in order to prepare the cover 10 for placement against the surface 22 of the toilet seat 12. FIG. 3B illustrates the major axis 24 and the use of at least one section of adhesive material 26 that has been asymmetrically positioned about the major axis 24.

Figure 3C:
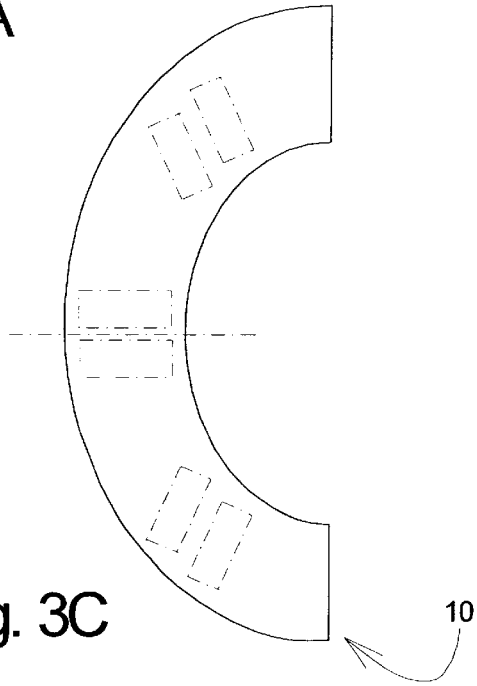
FIG. 3C illustrates the folding of the embodiment illustrated in FIG. 3B along the major axis.
Figure 3D:
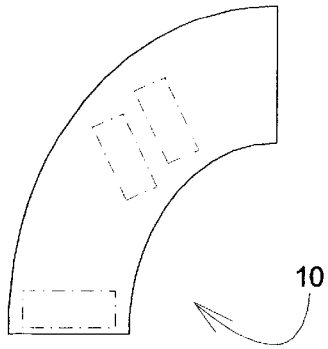
FIG. 3D illustrates the folding of the embodiment illustrated in FIG. 3B along a minor axis.
Figure 5:
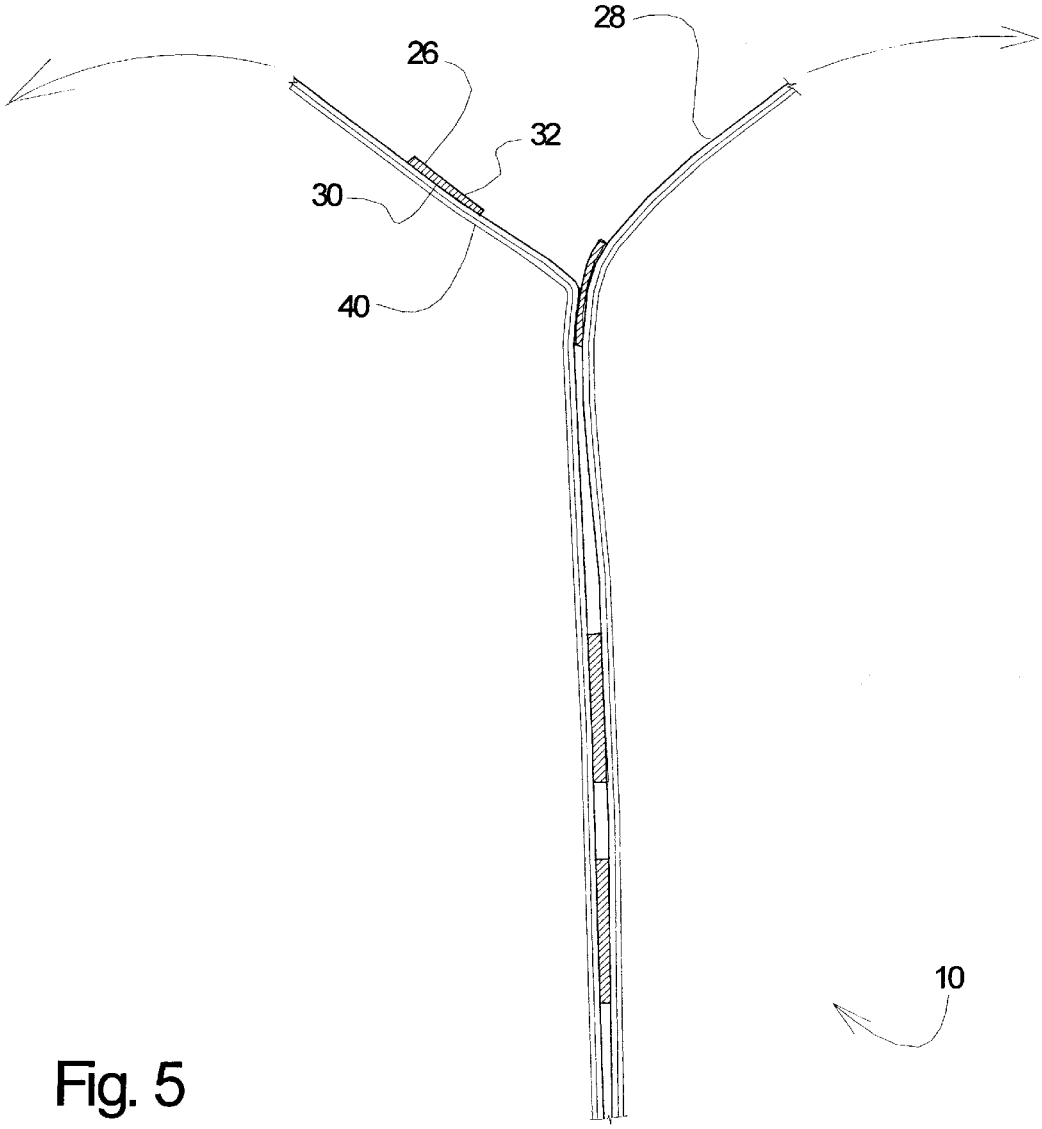
FIG. 5 illustrates the adhesion and peel-away function of the folded cover.

Referring to FIG. 3C and FIG. 5, it will be understood that the sections of adhesive material 26 will preferably be located on the lower surface 28 of the sheet of impermeable material 13. Additionally, each of the sections of adhesive material 26 will include an upper adhesive surface 30 and a lower adhesive surface 32, illustrated in FIG. 5. The lower adhesive surface 32 of the section of adhesive material 26 will be attached to the sheet of impermeable material 13 using an adhesive of a peel strength that prevents the section of adhesive material 26 from being easily removed from the sheet of impermeable material 13. Additionally, the upper adhesive surface 30 of the section of adhesive material 26 will be of or include an adhesive of a low peel-strength, or of a peel strength that is lower than the peel strength of the lower adhesive surface 32.

Figure 4A:
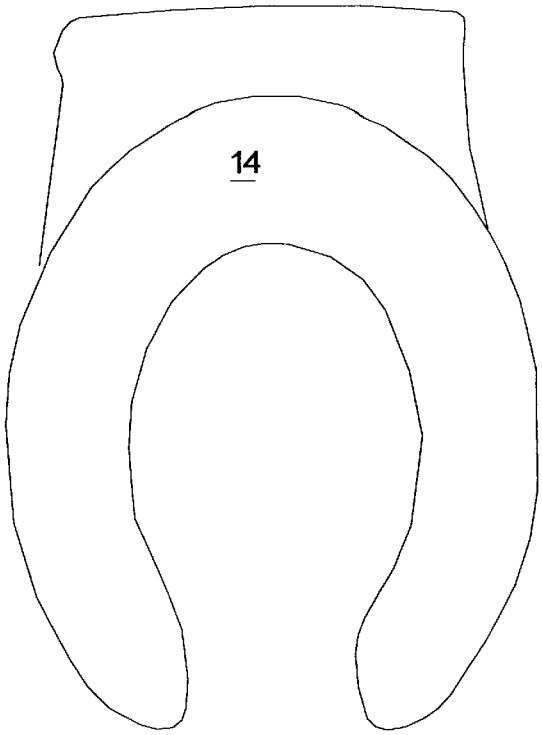
FIG. 4A is a plan view of the top surface of a U-shaped embodiment of the cover.
Figure 4B:
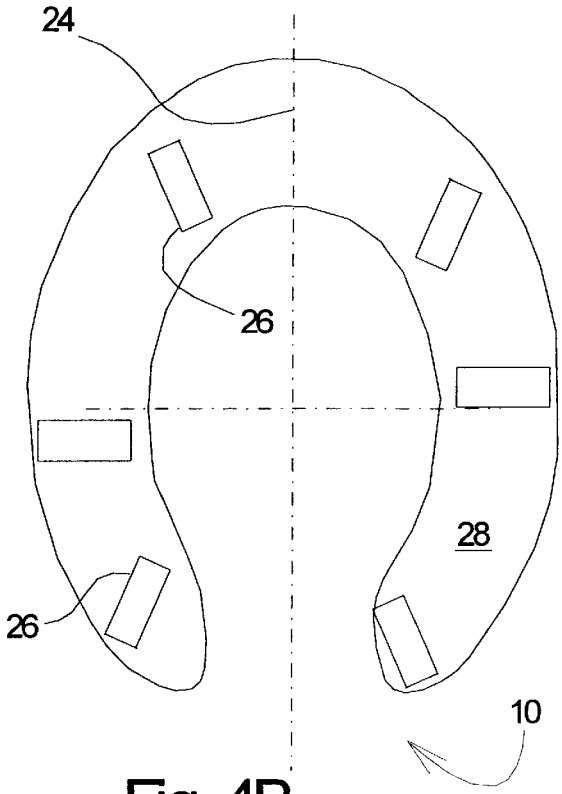
FIG. 4B is a plan view of the bottom surface of the embodiment illustrated in FIG. 4A.
Figure 4C:
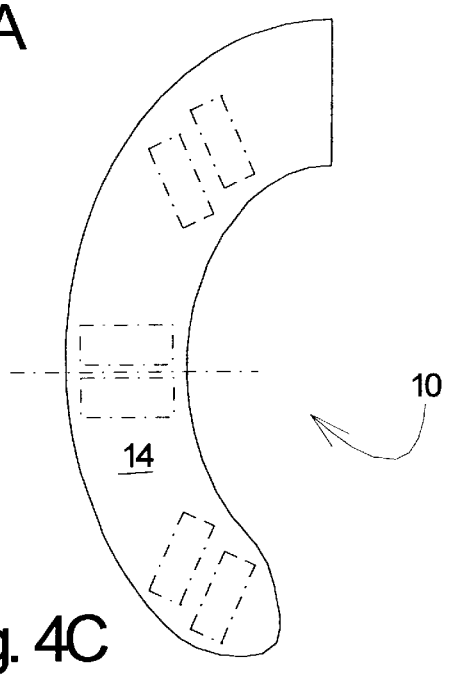
FIG. 4C illustrates the folding of the embodiment illustrated in FIG. 4B along the major axis.
Figure 4D:
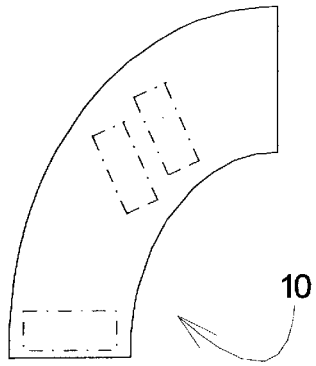
FIG. 4D illustrates the folding of the embodiment illustrated in FIG. 4B along a minor axis.

As illustrated in FIGS. 3C, 4C, and 5, when the sheet of impermeable material 13, is folded upon itself along the major axis 24, the upper adhesive surface 30 will contact an opposing area of the lower surface 28 of the cover 10. This will protect the adhesive and allow exposure of the adhesive on opening or unfolding of the cover 10. Thus the impermeable sheet material of the lower surface 28 will allow the cover 10 to incorporate the function of a peel-away cover, without adding the waste of a peel-away cover. Additionally, the disclosed arrangement will cut on the amount of time needed to open and apply the cover 10 by eliminating the need to strip away peel-away away covers to expose the adhesive. Thus, as illustrated in FIG. 5, unfolding of the sheet of impermeable material 13 exposes the upper adhesive surface 30, so that on placing the upper adhesive surface 30 on the surface of the toilet seat 12 the toilet seat cover 10 adheres against the toilet seat 12.

Referring once again to FIGS. 3A–3D, it will be understood that the sheet of impermeable material 13 may be generally oval in shape, or, as illustrated in FIGS. 4A–4D, the sheet of impermeable material 13 may be of generally U-shape to fit U-shaped toilet seats. Additionally, the opening or passage 36 a through the sheet of impermeable material 13 may be formed from a tear-away, scored area or simply be formed or cut from the sheet of impermeable material 13 prior to packaging the cover 10 for sales distribution.

Still further, as shown in FIG. 5, it will be appreciated that the sheet of impermeable material 13 may have a soft material 38, such as a fibrous matting 40, foam or other soft material that may insulate or make the cover more comfortable for the user.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A disposable, sanitary, protective cover for a toilet seat having a generally oval surface, the cover comprising:

A sheet of impermeable material that is generally symmetrical about a major axis, the sheet of impermeable material having an upper surface and a lower surface; and A plurality of sections of adhesive material located on the lower surface of the sheet of impermeable material, on one side of the major axis, the section of adhesive material having an upper adhesive surface and a lower adhesive surface, the lower adhesive surface of the section of adhesive material being attached to the sheet of impermeable material using an adhesive of a peel strength that prevents the section of adhesive material from being easily removed from the sheet of impermeable material, the upper adhesive surface of the section of adhesive material having an exposed adhesive of a low peel strength, said plurality of sections of adhesive material being asymmetrically positioned on said lower surface of said sheet of impermeable material, the sheet of impermeable material being folded upon itself about the major axis with the sheet of impermeable material adhered to the upper surface of section of adhesive material, so that unfolding of the sheet of impermeable material exposes the upper surface of the section of adhesive material, so that on placing the upper surface of the section of adhesive material against the surface of the toilet seat the upper surface of the area of adhesive material retains the toilet seat cover against the toilet seat while the lower surface of the section of adhesive material adheres to the sheet of impermeable material.

2. A cover according to claim 1 and further comprising a flexible enclosure adapted for accepting and storing the cover.

3. A cover according to claim 2 wherein said upper surface of said cover further comprises a layer of soft fibrous matting.

4. A cover according to claim 2 wherein said upper surface of the said cover further comprises a layer of soft, generally spongy material.

5. A disposable, sanitary, protective cover for a toilet seat having a generally oval surface, the cover comprising:

A generally oval sheet of impermeable material that is generally symmetrical about a major axis, the sheet of impermeable material having an upper surface and a lower surface, the lower surface of the sheet of impermeable material being smooth, and the upper surface of the sheet of impermeable material including a soft fibrous matting; and A plurality of sections of adhesive material located on the lower surface of the sheet of impermeable material, on one side of the major axis, the section of adhesive material having an upper adhesive surface and a lower adhesive surface, the lower adhesive surface of the section of adhesive material being attached to the sheet of impermeable material using an adhesive of a peel strength that prevents the section of adhesive material from being easily removed from the sheet of impermeable material, the upper adhesive surface of the section of adhesive material having an adhesive of a low peel strength, said plurality of sections of adhesive material being asymmetrically positioned on said lower surface of said sheet of impermeable material, the sheet being folded upon itself along the major axis with the lower surface of said sheet of impermeable material adhered to the upper surface of section of adhesive material, so that unfolding of the sheet of impermeable material exposes the upper surface of the section of adhesive material, so that on placing the upper surface of the section of adhesive material against the surface of the toilet seat the upper surface of the area of adhesive material retains the toilet seat cover against the toilet seat.

6. A cover according to claim 5 and further comprising a flexible enclosure adapted for accepting and storing the cover.

7. A method for making a disposable, sanitary protective cover for use against a toilet seat having a generally oval surface, the method comprising:

providing a generally oval sheet of impermeable material, the oval sheet of impermeable material being generally symmetrical about a major axis, the sheet of impermeable material having an upper surface and a lower surface; and depositing, on one side of the major axis, a plurality of sections of adhesive material on the lower surface of the sheet of impermeable material, the section of adhesive material having an exposed upper adhesive surface and a lower adhesive surface, the lower adhesive surface of the section of adhesive material being attached to the sheet of impermeable material using an adhesive of a peel strength that prevents the section of adhesive material from being easily removed from the sheet of impermeable material, the upper adhesive surface of the section of adhesive material having an adhesive of a low peel strength, said plurality of sections of adhesive material being asymmetrically positioned on said lower surface of said sheet of impermeable material, and folding the sheet upon itself about the major axis to adhere the lower surface of the sheet to the upper surface of section of adhesive material, so that unfolding of the sheet of impermeable material exposes the upper surface of the section of adhesive material, so that on placing the upper surface of the section of adhesive material against the surface of the toilet seat the upper surface of the area of adhesive material retains the toilet seat cover against the toilet seat.

* * * * *